US005532392A

United States Patent [19]

Gheorghiu

[11] Patent Number: 5,532,392

[45] Date of Patent: Jul. 2, 1996

[54] PROCESS FOR THE PREPARATION OF METHYL FATTY ACID ESTERS STARTING FROM NATURAL OIL OR FAT, METHYL ESTERS OBTAINED IN THIS WAY AND USE THEREOF

[76] Inventor: Mihail Gheorghiu, Lt L. Emmerechtsplein 4, Box 8, 1853 Strombeek-Bever, Belgium

[21] Appl. No.: 181,307

[22] Filed: Jan. 13, 1994

[51] Int. Cl.[6] ..... C11C 1/00

[52] U.S. Cl. ..... 554/169; 502/349; 502/350

[58] Field of Search ..... 554/169; 502/349, 502/350

[56] References Cited

U.S. PATENT DOCUMENTS

| | | | |
|---|---|---|---|
| 2,808,421 | 10/1957 | Brokaw | 260/410.8 |
| 4,032,550 | 6/1977 | White et al. | 260/410.6 |
| 4,668,439 | 5/1987 | Billenstein et al. | 260/410.9 |
| 5,138,106 | 8/1992 | Wilmott et al. | 568/877 |

FOREIGN PATENT DOCUMENTS

| | | |
|---|---|---|
| 2332806 | 11/1976 | France . |
| 2560210 | 8/1985 | France . |
| 0070492A3 | 1/1983 | Germany . |
| 3421217A1 | 6/1984 | Germany . |
| 90/0812 | 7/1990 | WIPO . |

*Primary Examiner*—José G. Dees
*Assistant Examiner*—Deborah D. Carr
*Attorney, Agent, or Firm*—Birch, Stewart, Kolasch & Birch

[57] ABSTRACT

A process for the preparation of methyl fatty acid esters starting from natural oil or fat by transesterification with methanol in the presence of a catalyst of an organotitanate based catalyst, in particular of tetrabutyl orthotitanate, methyl esters as obtained in this way and use thereof as fuel.

19 Claims, No Drawings

PROCESS FOR THE PREPARATION OF METHYL FATTY ACID ESTERS STARTING FROM NATURAL OIL OR FAT, METHYL ESTERS OBTAINED IN THIS WAY AND USE THEREOF

BACKGROUND OF THE INVENTION

1. Field of the Invention

The present invention relates to a process for the preparation of methyl fatty acid esters starting from natural oil or fat by transesterification with methanol in the presence of a catalyst.

2. Description of the Prior Art

The methyl esters derived from natural oil or fat have become important in the oleochemic industry as fuel or as raw materials for the preparation of several derivatives, such as fatty alcohols or fatty alkanolamides. These methyl esters can be prepared by esterification of fatty acids but i the conventional process used for the preparation of these methyl esters is the catalytic transesterification or methanolysis of triglycerides, i.e. an ester substitution, with an excess of methanol. During the transesterification, which is effected according to the following reaction scheme:

$$\begin{matrix}\text{oil} \\ \text{or} + \text{methanol} \\ \text{fat}\end{matrix} \longrightarrow \text{methyl esters} + \text{glycerol},$$

the glycerol molecule in the triglyceride is replaced by three methanol molecules. The preparation of methyl esters by transesterification is described in "Manufacture of Fatty Alcohols Based on Natural Fats and Oils" from U. R. Kreutze, JAOCS, vol. 61, No. 2 (February 1984), pages 343–345 and in "CEH Marketing Research Report—Detergent Alcohols" from R. F. Modler et al., 1990, Chemical Economics Handbook, SBI International.

In these known processes, a good yield of fatty acid esters obtained by the use of an alkaline catalyst, such as sodium or potassium hydroxide in a solution in methyl alcohol or sodium methylate.

The use of an alkaline catalyst involves however several drawbacks:

- the alkaline catalyst is very corrosive and in view of its high pH (in the range of 8 to 10), the reaction medium gives also very corrosive by-products; consequently, the equipment used for the process has to be in stainless steel;
- an additional neutralisation step of the free fatty acids contained in the oil or in the fat is necessary together with a separation of the so-formed soap;
- an additional step for refining the glycerol containing waters and for separating the salt is also necessary;
- the recuperation efficiencies of the methanol excess and of the glycerol are low.

SUMMARY OF THE INVENTION

One of the essential objects of the present invention consists in obviating the above mentioned drawbacks of the existing processes and in providing an industrially and economically valuable process permitting to obtain methyl esters at a high efficiency and which especially does not require a neutralization of fatty acids and which does not use or does not give rise to corrosive products.

To this end, the process according to the invention consists in using, as catalyst, an organotitanate based catalyst.

Advantageously, the organotitanate is selected within the group comprising tetraalkyl orthotitanates, monomeric and polymeric cresyl titanates, titanium lactate, stearic titanate, 2-ethylhexyl titanate, polymeric n-butyl titanate, titanium acetylacetonate, triethanolamine titanate, octylene glycol titanate and mixtures of two or more of these substances.

According to an advantageous embodiment of the invention, use is made as organotitanate of a tetraalkyl orthotitanate comprising 1 to 5 carbon atoms, tetrabutyl orthotitanate being particularly well suited in this respect.

According to a particularly advantageous embodiment of the invention, the catalyst comprises zinc acetylacetonate, the amount of zinc acetylacetonate being 2 to 5% by weight and preferably 3% by weight with respect to the titanium of the catalyst.

According to an advantageous embodiment of the invention, the oil or the fat, the methanol and the catalyst are mixed together before being subjected to the transesterification.

According to a particularly advantageous embodiment of the invention, the transesterification is effected at a pressure of 35 to 60 bars, preferably of 45 to 55 bars and at a temperature of 150° to 300° C., preferably of 200° to 250° C., a pressure situated between 48 and 50 bars and a temperature of between 222° and 227° C. appearing to be particularly advantageous.

The present invention relates also to methyl fatty acid esters as obtained in this way and their use as fuel whether mixed with other fuels or not.

Other details and particularities of the invention will become apparent from the following description given hereinafter by way of non limiting example or from some particular embodiments of the invention.

The present invention relates to a process for the preparation of methyl fatty acid esters starting from natural oil or fat by transesterification with methanol in the presence of a catalyst, which consists in the use, as catalyst, of a catalyst comprising one or more organotitanates. In this patent application, the term organotitanates includes also titanium (organo)carboxylates but no other titanium, compounds, in particular no titanium salts of organosulfonic acids. Amongst these organotitanates which may be appropriate to this effect, especially tetraalkyl orthotitanates, in particular tetraalkyl orthotitanates comprising 1 to 5 carbon atoms, monomeric and polymeric cresyl titanates, titanium lactate, stearic titanate, 2-ethylhexyl titanate, polymeric n-butyl titanate, titanium acetylacetonate, triethanolamine titanate and octylene glycol titanate can be mentioned. $C_1$–$C_5$ tetraalkyl orthotitanates appeared to be particularly advantageous. Examples thereof are especially tetraethyl, tetrapropyl, tetraisopropyl, tetrabutyl and tetraisobutyl orthotitanates. The organotitanate which is preferred as catalyst is tetrabutyl orthotitanate. The catalyst may also comprise a small amount of zinc acetylacetonate, which increases the activity of the organotitanate. The amount of zinc acetylacetonate of the catalyst being 2 to 5% by weight, and preferably 3% by weight with respect to the titanium.

According to the invention, the oil or the fat, the methanol and the catalyst are mixed before being introduced into the transesterification reactor in view of obtaining, on the one hand, a fine dispersion of the catalyst in the reaction mixture and, on the other hand, to protect the catalyst from e too long contact with, the hydroxyl radicals of the methanol. This previous mixing, when performed, and the transesterification are carried out in a general way at a pressure of 35 to 60 bars and at a temperature 150° to 300° C., a pressure of 45 to 55 bars and a temperature of 200° to 250° C. being preferred. Particularly advantageous results are, however, achieved with a pressure situated between 48 and 50 bars and a temperature situated between 222° and 227° C. Generally, the oil or the fat and the methanol are kept in the presence of the organotitanate based catalyst for about 0. 5 to 4 hours and preferably for 2 to 3 hours. A good reaction efficiency is achieved when the amount of catalyst per ton of oil or fat is comprised between 0.5 and 1.5 kg and preferably when it comprises about 1.3 kg. In order to obtain methyl fatty acid esters starting from natural oil or fat by transesterification, the fat or the oil has to be mixed with an excess of methanol which corresponds to 1 to 3 times the stoichiometric quantity required for replacing the glycerol bound in the fat or in the oil.

The oil or fat to be mixed with the methanol may contain free acid, i.e. a free fatty acid content up to 5% and has consequently normally not to be neutralized. However, in view of the fact that the orthotitanate based catalyst requires oil or fat having a low water and phosphorus content, the oil or the fat will have to be pretreated before being mixed possibly in advance with the methanol and with the catalyst and before the transesterification reaction. According to the invention, the pretreatment of the oil or of the fat includes two steps, i.e. an acid degumming to reduce its phosphorus content to 50 ppm or less and a dry pre-treatment followed by a filtration for example on active bleaching earth, to reduce the humidity to about 0.01% and the phosphorus content to 15 ppm or less. It will be noticed that most of the vegetable oils, such as colza oil, have a humidity content of 0.3 to 0.5% and contain 1 to 2% gums (phospholipids). Consequently, the raw oil or fat will have to be subjected to said two step pretreatment, i.e. to the acid degumming step and to the combined drying and filtration step. During the degumming step, the phosphorus content will be reduced for example to 25 to 50 ppm and during the drying and filtration step, the humidity will be reduced for example to 0.01% and the phosphorus content will be further reduced, for example to 1–1 ppm. It will be clear that when use is made of degummed oil, only the drying step will be necessary.

By natural oil or fat, there is intended within the scope of the present invention oil or fat having a linear fatty acid chain. All of the vegetable oils are usable, in particular colza oil, palm oil and cabbage palm oil. All of the animal fats are also usable.

The preheated liquid mixture comprising the oil or the fat to be treated, the methanol of a purity of at least 99% advantageously of 99,5% and the catalyst are preferably continuously introduced into the reactor by a high pressure pump. It crosses the transesterification zone which is kept at the specified temperature and pressure. During the transesterification reaction, the catalyst is consumed and finally eliminated as residue. In this respect, it will be noted that it is not necessary to mix the oil or the fat, the methanol and the catalyst before being introduced into the reactor. The mixing Operation may take place partially or entirely into the reactor. The oil and the catalyst may be mixed and this mixture may be introduced into the reactor simultaneously with the methanol or the three components may be introduced simultaneously into the reactor and mixed therein.

After the reaction, the duration of which is comprised between about 0.5 to 4 hours and preferably between about 2 to 3 hours, the product leaving the reactor is then subjected to an instantaneous evaporation in a first separator wherein the excess of methanol is evaporated. This evaporated methanol is recycled after condensation and distillation and is re-used in the transesterification step. The mixture is then transferred to a second separator which eliminates the last methanol traces. The mixture of methyl esters and glycerol is introduced into a decanter. The upper phase is composed of methyl esters while the lower phase is composed of glycerol. The glycerol requires no further refining and may be concentrated directly from 40–50% to 82–88%. Pharmaceutical grade glycerol is obtained by distillation of the concentrate$_d$ product. The glycerol present in the methyl esters is removed by washing in counter current with demineralized water. In case it appears to be necessary, the methyl esters are distilled. The purity of the methyl esters prior to the distillation is higher than 95%.

In case the methyl esters obtained according to the process of the invention are used as fuel mixed with other fuels, for example in a 50/50 ratio with gas oil, they do not have to be distilled but only to be dried to a humidity content lower than 0.05%. In case they are used as a 100% fuel or as raw material for oleochemical derivatives, they have to be distilled to a purity higher than 98.5%. These:methyl fatty acid esters may also be transformed by hydrogenation in the presence of a copper chromide catalyst into fatty alcohols. The conversion into alkanolamides, into sulfonated esters or into other derivatives is possible by known conventional reactions.

The following examples illustrate the invention without forming however a limitation therefor.

EXAMPLE 1

1000 kg of palm oil and/or of cabbage palm oil are mixed to 300 kg of methanol and 1.5 kg of tetraisobutyl orthotitanate at a pressure of 50 bars and at a temperature of 220° C. and then transferred into a reactor which is also maintained under a pressure of 50 bars and at a temperature of 220° C. The mixture in the reactor is subjected to a liquid horary space velocity (LHSV) of 4–6 m/hour and is kept therein for 2.5 hours. The product leaving the reactor is subjected to an instantaneous evaporation, a separation and a decantation The obtained methyl esters are of a purity of more than 95%.

EXAMPLE 2

Raw colza oil obtained by pressure and solvant extraction containing less than 4% free fatty acids, a humidity of 0.5%, 2% of gums and 1% of solid matter is degummed and dried. 1000 kg of this oil is then admixed to 300 kg of methanol and 1.5 kg of tetraisopropyl orthotitanate and treated under the same conditions as those of example 1. The obtained methyl esters are also of a purity of more than 95%.

EXAMPLE 3

Example 1 is repeated but with colza oil instead of palm oil and/or cabbage palm oil. Similar results are obtained.

EXAMPLE 4

1000 kg of palm oil, cabbage palm oil or colza oil is admixed to 300 kg of methanol and 1.5 kg of tetraisobutyl orthotitanate containing 3% by weight of zinc acetylacetonate (with respect to titanium) and the process is further carried out under the same conditions as those illustrated in example 1. Methyl esters of a purity of more than 95% are also obtained.

In addition to the advantages which have already been mentioned hereinabove, the process for the preparation of methyl esters according to the invention is extremely simple and economical implement. The raw oil or fat has only to be degummed and dried and does not require, as in the conventional processes, a fatty acid elimination step neither chemically (alkaline neutralization) nor physically (steam distillation). The obtained raw glycerol contains very little non volatile products and does not require a chemical refining nor a soap separation before being concentrated. The obtained raw methyl esters have also a very high purity. As already indicated, in view of the fact that the catalyst is not alkaline and not corrosive and no corrosive by-products are formed, the reactor and the auxiliaries can be constructed essentially of soft steel and, for example, partially of ordinary stainless SS 304 steel. In addition to the fact that the process can be carried out as a continuous process, the catalyst consumption is also very low and will have only a small influence onto the purity of the final products and onto the operation costs of the process.

It has to be understood that the present invention is in no way limited to the hereinabove described embodiments and that many modifications can be applied thereto without leaving the scope of the present patent.

What is claimed is:

1. A process, which comprises:

transesterifying natural oil or fat with methanol in the presence of an organotitanate based catalyst to form methyl fatty acid esters;

wherein said catalyst further comprises zinc acetylacetonate.

2. The process as claimed in claim 1, wherein the organotitanate is selected from the group consisting of tetraalkyl orthotitanate, monomeric and polymeric cresyl titanates, titanium lactate, stearic titanate, 2-ethylhexyl titanate, polymeric n-butyl titanate, titanium acetylacetonate, triethanolamine titanate, octylene glycol titanate and mixtures of two or more of these substances.

3. The process as claimed in claim 2, wherein said organotitanate is a tetraalkyl orthotitanate wherein each of the alkyl groups contains 1 to 5 carbon atoms.

4. The process as claimed in claim 3, wherein the tetraalkyl orthotitanate is tetrabutyl orthotitanate.

5. The process as claimed in claim 1, wherein said catalyst comprises an amount of 2 to 5% by weight of zinc acetylacetonate with respect to the titanium.

6. The process as claimed in claim 5, wherein said amount of zinc acetylacetonate equals 3% by weight.

7. The process as claimed in claim 1, wherein the oil or the fat, the methanol and the catalyst are mixed together before being subjected to the transesterification step.

8. The process as claimed in claim 1, wherein the transesterification step is effected at a pressure of 35 to 60 bars and at a temperature of 150° to 300° C.

9. The process as claimed in claim 8, wherein the transesterification step is effected at a pressure of 45 to 55 bars and at a temperature of 200°to 250° C.

10. The process as claimed in claim 9, wherein said pressure is between 48 and 50 bars and said temperature between 222° and 27° C.

11. The process as claimed in claim 8, wherein the transesterification step takes 0.5 to 4 hours.

12. The process as claimed in claim 11, wherein the transesterification step takes 2 to 3 hours.

13. The process as claimed in claim 1, wherein said catalyst is used in an amount of between 0.5 and 1.5 kg per ton of oil or fat.

14. The process as claimed in claim 13, wherein said catalyst is used in an amount of about 1.3 kg per ton oil of or fat.

15. The process as claimed in claim 1, wherein said methanol is used in an amount which comprises 1 to 3 times the stoichiometric amount necessary for replacing the glycerol bound in the oil or in the fat.

16. The process as claimed in claim 1, wherein the used oil or fat has a free acid content not higher than 5%.

17. The process as claimed in claim 16, wherein prior to said transesterification step, the oil or the fat is degummed and dried subsequently.

18. The process as claimed in claim 17, wherein through said degumming step, the phosphorus content is reduced to 50 ppm or less.

19. The process as claimed in claim 17, wherein through said drying step, followed by a filtration step, the humidity content is reduced to 0.01% or less and the phosphorus content to 15 ppm or less.

* * * * *